US006763587B2

(12) United States Patent
Jinnai et al.

(10) Patent No.: US 6,763,587 B2
(45) Date of Patent: Jul. 20, 2004

(54) MANUFACTURING METHOD OF COMPONENT PART FOR VARIABLE CAPACITY TURBINE, AND THE STRUCTURE

(75) Inventors: Yasuaki Jinnai, Kanagawa-ken (JP); Koji Matsumoto, Kanagawa-ken (JP); Taro Sakamoto, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/105,376

(22) Filed: Mar. 26, 2002

(65) Prior Publication Data

US 2002/0136630 A1 Sep. 26, 2002

(30) Foreign Application Priority Data

Mar. 26, 2001 (JP) ..... 2001-088569

(51) Int. Cl.[7] ..... F01D 17/16; B21K 25/00

(52) U.S. Cl. ..... 29/889.2; 415/163; 415/164; 415/204

(58) Field of Search ..... 415/160, 163, 415/164, 204, 206; 29/889.2

(56) References Cited

U.S. PATENT DOCUMENTS 4,657,476 A * 4/1987 Berg ..... 415/48
4,726,744 A * 2/1988 Arnold ..... 417/407
5,000,911 A * 3/1991 Ekbom ..... 419/49
6,409,483 B2 * 6/2002 Jinnai ..... 417/407
6,471,470 B2 * 10/2002 Yoshimura et al. ..... 415/160

* cited by examiner

*Primary Examiner*—Ninh H. Nguyen
(74) *Attorney, Agent, or Firm*—Wenderoth, Lind & Ponack, L.L.P.

(57) ABSTRACT

A manufacturing method for manufacturing a component part for a variable capacity turbine, and the structure of a nozzle driving member, will simplify the structure of the component parts for the adjustable nozzle mechanism, the manufacturing work, which results in lowering the manufacturing count and cost as well as the number of component parts, and in lightening the weight of the variable capacity turbine. In order to manufacture the component parts for a radial-flow variable capacity turbine, in which actuating gas is forced to flow from a spiral scroll formed in a turbine casing to a turbine rotor in a radial direction through multiple nozzle vanes, of which the angle is adjustable by an adjustable nozzle mechanism, for rotating a turbine rotor, this manufacturing method has a column shaped connecting pin formed as a single structure with a plate member by pressing, or by precision molding by partially forcing the surface of the plate member to protrude in a column shape.

2 Claims, 6 Drawing Sheets

PRIOR ART

MANUFACTURING METHOD OF COMPONENT PART FOR VARIABLE CAPACITY TURBINE, AND THE STRUCTURE

BACKGROUND OF THE INVENTION

1. Field of Invention

This invention relates to a manufacturing method of the component part for a variable capacity turbine which is used in the supercharger (the exhaust gas turbocharger) of internal combustion engines or the so forth, and the structure of the component part. The variable capacity turbine is configured in such a way that the actuating gas flows from a spiral scroll formed in the turbine casing to the turbine rotor in a radial direction through multiple nozzle vanes provided with wings of a variable angle for rotating the turbine rotor. This invention relates specially to a manufacturing method of a nozzle driving member for the adjustable nozzle mechanism and a connecting member to connect the nozzle driving member and the nozzle vanes, and the structure of the component part.

2. Description of the Related Art

In order to make a good match with regard to the internal combustion engine, between the outflow exhaust gas volume from the engine and the actuating gas flow volume, which should be determined for the optimum operation condition of the supercharger, variable capacity superchargers, equipped with a variable capacity turbine capable of changing the exhaust gas volume to be sent from the spiral scroll to the turbine rotor in accordance with the operation condition of the engine, have been in widespread use in recent years.

An example of the conventional adjustable nozzle mechanism used in such variable capacity turbine is shown in FIG. 7 and FIG. 8.

FIG. 7 illustrates the essential cross sectional view (C—C cross section shown in FIG. 8) highlighting the connecting portion of the link assembly and the lever plate, and FIG. 8 illustrates D-arrowed view in FIG. 7.

In FIG. 7 and FIG. 8, the link assembly 10 in the adjustable nozzle mechanism is configured by a circular shaped link plate 3 into which connecting pins 03*a*, which are manufactured separately from the link plate 3, are fixed in a circumferential direction by press—insert or by welding, etc. In the adjustable nozzle mechanism, one end of lever plate 1 is fixed to each nozzle shaft 02 of the nozzle vane, and as shown in FIG. 7, the other end of lever plate 1 is provided with a recess 1*c* which engages with a connecting pin 03*a* of link assembly 10 with a small enough gap to maintain the normal function of the nozzle vanes (not shown in the figure).

In the prior art mentioned above, however, since the connecting pins 03*a*, connecting the circular-shaped link plate 3 and lever plates 1 provided in a circumferential direction, are manufactured separately from link plate 3, fixed by press-insert or by welding, etc., it is necessary to fix a number of connecting pins 03*a* along the circumferential direction of link plate 3 in the above mentioned way. This requires a separate process count for manufacturing the connecting pins 03*a*, and it also requires the assembling process to assemble the connecting pins 03*a* into the link plate 3. As a result, these processes drive the link assembling count and manufacturing costs higher.

An addition problem is, since link plate 3 and the connecting pins 03*a* are manufactured separately, the number of component parts will be increased and the total weight of link assembly 10 will also be increased. Thus the prior arts have the above mentioned problems.

SUMMARY OF THE INVENTION

In consideration of the problems with the conventional arts mentioned above, the object of this invention is to propose a manufacturing method for manufacturing a component part for the variable capacity turbine, and the structure of the nozzle driving member, which will simplify the structure of the component part for the adjustable nozzle mechanism, the manufacturing work which results in lowering the manufacturing count and cost, as well as the number of component part, and in lightening the weight of the variable capacity turbine.

The invention is applied to solve these problems, and the variable capacity turbine for applying this invention is a radial-flow variable capacity turbine. It is configured in such a way that the actuating gas is forced to flow from a spiral scroll formed in the turbine casing to the turbine rotor in a radial direction, through multiple nozzle vanes of which the angle is adjustable by the adjustable nozzle mechanism, for rotating the turbine rotor. The manufacturing method for the component part for the variable capacity turbine according to this invention is distinguished by the configuration in which, for manufacturing a connecting pin which transmits the driving force to the engaging counter member by engaging with a recess or a hole formed in the counter member out of the component parts of the adjustable nozzle mechanism, and a plate member connected to the connecting pin, the manufacturing method includes a step of forming the connecting pin as a single structure with the plate member by partially forcing a surface of the plate member to protrude in a column shape.

In this invention, when the connecting pin and the plate member are formed as a single structure, the connecting pin can be formed preferably by a pressing, in which one side surface of the plate member is pressed towards the opposite side surface by a male molder to depress and form a depressed portion, then a protrusion formed on the opposite side surface of the depressed portion is accepted into the molding cap of the female molder in order to form the connecting pin having a column shape.

As an alternative, the connecting pin can be formed preferably by precision molding as a single structure with the plate member.

Further, this invention is applied to the variable capacity turbine which is configured in the following way. The actuating gas is forced to flow from a spiral scroll formed in the turbine casing in a radial direction to the turbine rotor, through multiple nozzle vanes of which the angle is adjustable by the adjustable nozzle mechanism, for rotating the turbine rotor. The adjustable nozzle mechanism is provided on the nozzle mount fixed to the turbine casing in such a way that the mechanism is free to rotate, and is provided along the circumferential direction of the turbine. The circular shaped nozzle driving member provided around the turbine shaft in such a way that it is free to rotate by an actuator, drives the nozzle vanes. One end of a connecting member is fixed to the nozzle vane shaft of each nozzle vane, the other end of the connecting member is engaged with a recess or a hole through a connecting pin to engage with the nozzle driving member. The same number of connecting members are provided as the number of nozzle vanes. In the manufacturing method to manufacture such component part in the variable capacity turbine, the method is distinguished by comprising the steps of: forming either the nozzle driving member or the connecting member with a plate member, and forming the connecting pin as a single structure with the plate member by partially forcing a surface of the plate member to protrude in a column shape by pressing or by precision molding.

Furthermore, this invention is applied to the variable capacity turbine which is configured in the following way. The actuating gas is forced to flow from a spiral scroll formed in the turbine casing in a radial direction to the turbine rotor, through multiple nozzle vanes of which the angle is adjustable by the adjustable nozzle mechanism, for rotating the turbine rotor. The multiple nozzle vanes are provided on the nozzle mount fixed to the turbine casing in such a way that they are free to rotate, and are provided along the circumferential direction of the turbine. The circular shaped nozzle driving member provided around the turbine shaft in such a way that it is free to rotate by an actuator, drives the nozzle vanes. One end of a connecting member is fixed to the nozzle vane shaft of each nozzle vane, the other end of the connecting member is engaged with a recess or a hole through the connecting pin to engage with the nozzle driving member. The same number of connecting members are provided as the number of nozzle vanes. In the structure of a connecting member in the variable capacity turbine, it is distinguished by the configuration comprising: either the nozzle driving member or the connecting member formed with a plate member, and the connecting pin formed as a single structure with the plate member by partially forcing a surface of the plate member to protrude in a column shape.

According to the invention mentioned above, when it is manufactured the connecting pin which transmits the driving force to the counter member engaging with the recess or hole, etc. formed in the counter member of the component parts in the adjustable nozzle mechanism, and the plate member to engage with the connecting pin, it uses a manufacturing method to form a column shaped connecting pin protruding from a surface of the plate member as a single structure with the plate member, in other words, it uses either the pressing method comprising a step of pressing one side surface of the plate member towards the opposite side surface by a male molder to depress and form a depressed portion, and accepting the protrusion formed on the opposite side surface of the depressed portion into the molding cap of the female molder, or the precision molding method to form the connecting pin as a single structure with the plate member. Since the component part for the adjustable nozzle mechanism including the nozzle driving member and the connecting member connecting the nozzle driving member and the nozzle vanes are manufactured by these manufacturing methods, the work for forming the column shaped connecting pin on the component part by pressing or precision molding, specially the work for forming a plurality of connecting pins along a circumferential direction of the nozzle driving member, can be performed by a single process of pressing or precision molding.

This can eliminate the additional work necessary to manufacture the connecting pin separately from the nozzle driving member (link plate), as well as the work necessary to fix the connecting pins to the nozzle driving member. With this invention, since the nozzle driving member and the connecting pins, or the connecting member and the connecting pins are formed as a single structure, it can dramatically cut the manufacturing count and cost of the component part for the variable capacity turbine including the nozzle driving member and the connecting member as compared to the prior arts.

Further, by uniting the nozzle driving member and the connecting pins, or the connecting member and the pins, they can be a single structure, so the number of the component part will be decreased as compared to the prior arts in which the connecting pins are manufactured separately, and the total weight of the component part used in the variable capacity turbine will become lighter.

DETAILED DESCRIPTION OF THE PREFERRED EMBODIMENTS

In the following section we shall give a detailed explanation of the invention with reference to the drawings. Insofar as the size, material and shape of the components and the relative position of the components, or other features disclosed in these embodiments, they are not intended to limit the scope of the invention, but serve merely as examples to clarify the invention unless otherwise there is a specific disclosure.

Figure 1:
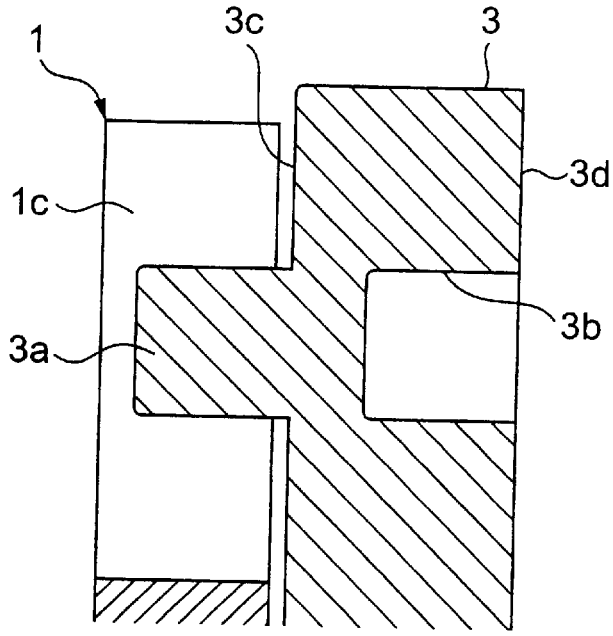
FIG. 1 shows an enlarged cross-sectional view of the connecting portion of the link assembly and the lever plate of the adjustable nozzle mechanism according to the first preferred embodiment of this invention, corresponding to the Z section in FIG. 3.
Figure 2:
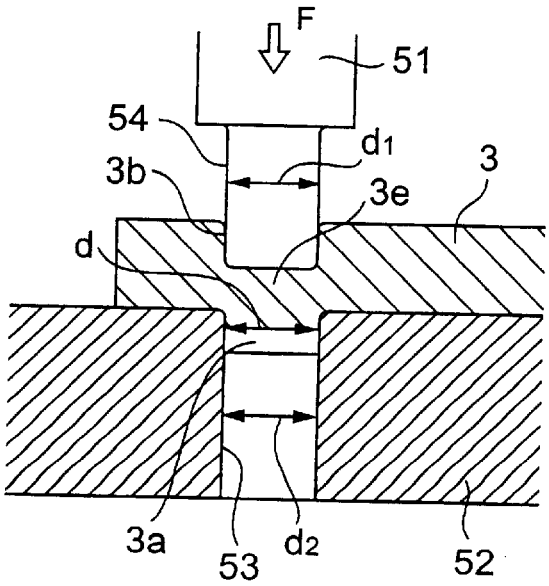
FIG. 2 shows an essential cross-sectional view of the manufacturing method for the connecting pin according to the first preferred embodiment of this invention.
Figure 3:
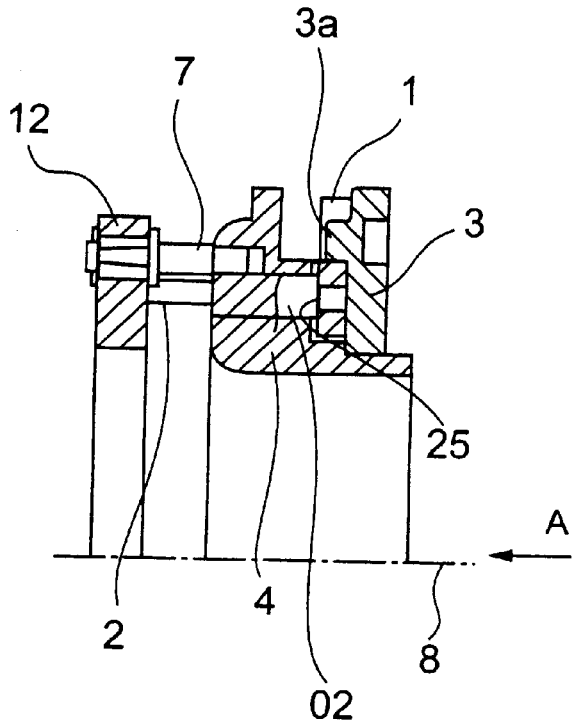
FIG. 3(A) shows a cross-sectional view along the turbine rotor shaft of the adjustable nozzle mechanism according to the first preferred embodiment of this invention (the B—B cross section shown in FIG. 4).
FIG. 3(B) shows an essential cross-sectional view corresponding to FIG. 3(A) according to the second preferred embodiment of this invention.
Figure 3:
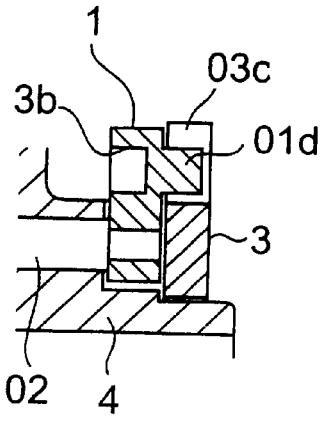
Figure 4:
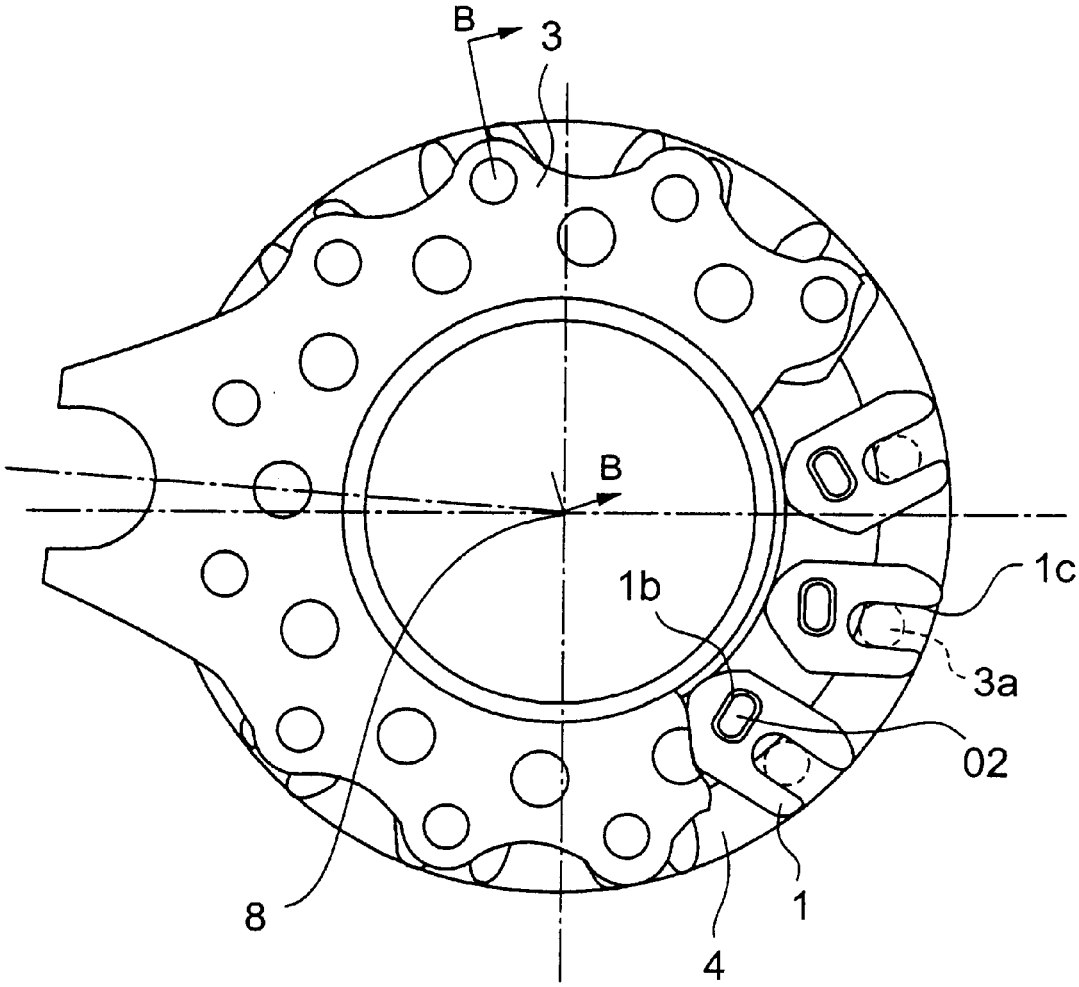
FIG. 4 shows an A-arrowed view in FIG. 3(A).
Figure 5:
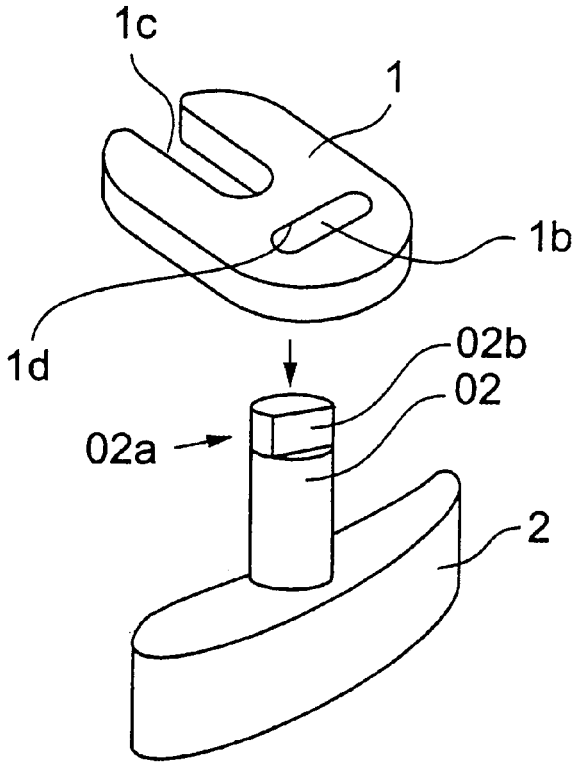
FIG. 5 shows a perspective view of the connecting portion of the nozzle vane and the lever plate.
Figure 6:
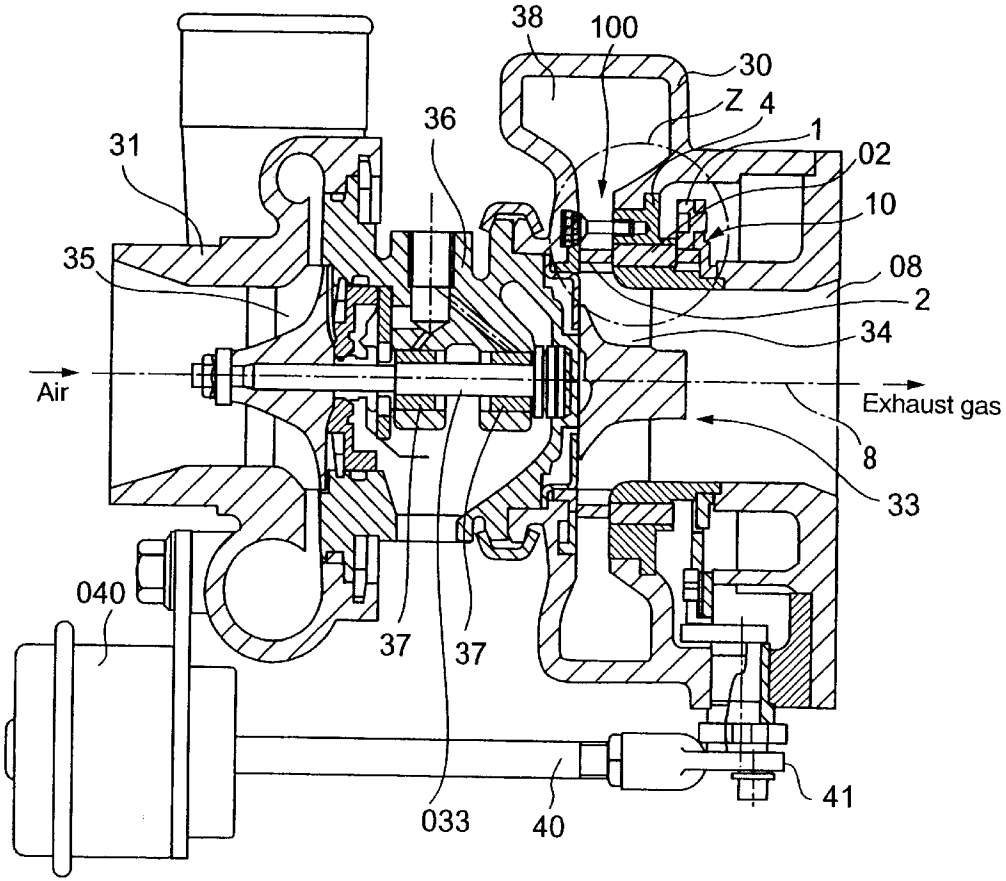
FIG. 6 shows a cross-sectional view along the rotor shaft of the supercharger with the variable capacity turbine to which this invention is applicable.
Figure 7:
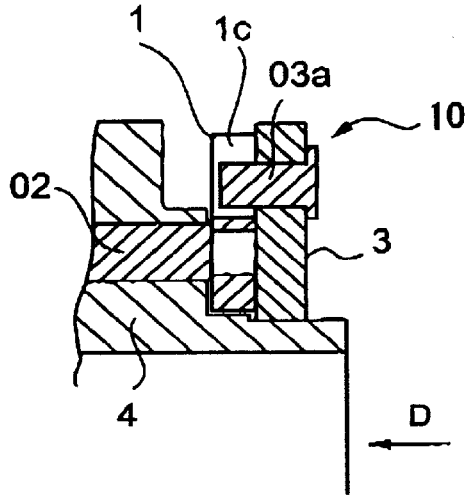
FIG. 7 shows an essential cross-sectional view of the connecting portion of the link assembly and the lever plate according to the prior art (the C—C arrowed view in FIG. 8).
Figure 8:
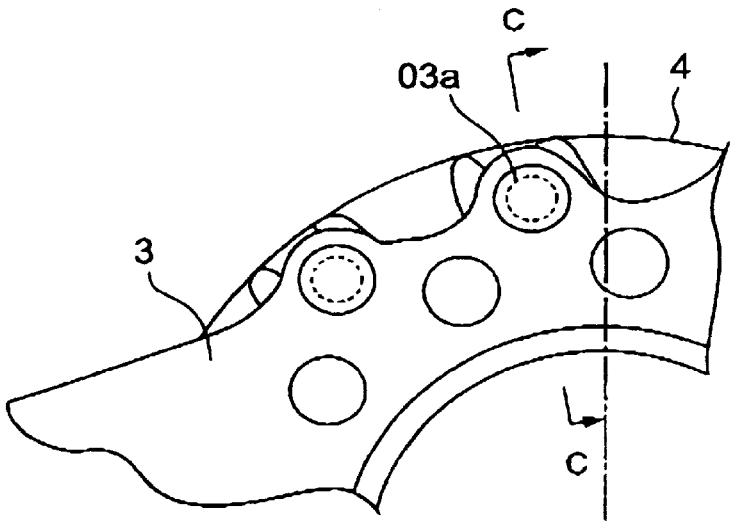
PRIOR ART FIG. 8
FIG. 8 shows a D-arrowed view in FIG. 7.

FIG. 1 shows an enlarged cross-sectional view of the connecting portion of the link assembly and the lever plate according to the first preferred embodiment of this invention, corresponding to the Z section in FIG. 6. FIG. 2 shows the essential cross-sectional view of the manufacturing method for the connecting pin according to the first preferred embodiment of this invention. FIG. 3(A) shows the cross-sectional view along the turbine rotor shaft of the adjustable nozzle mechanism according to the first preferred embodiment (the B—B cross section shown in FIG. 4). FIG. 3(B) shows the essential cross-sectional view corresponding to FIG. 3(A) according to the second preferred embodiment. FIG. 4 shows the A-arrowed view in FIG. 3(A).
FIG. 5 shows the perspective view of the connecting portion of the nozzle vane and the lever plate. FIG. 6 shows the cross-sectional view along the rotor shaft of the supercharger with the variable capacity turbine to which this invention is applicable.

FIG. 6 shows the entire structure of the supercharger with variable capacity turbine to which this invention is applicable, 30 is the turbine casing, and 38 is the scroll formed in spiral around the circumferential section in the turbine casing 30. 34 is a turbine wheel, 35 is the compressor wheel, 033 is the rotor shaft to join the turbine wheel 34 to the compressor wheel 35, both of which compose the turbine rotor 33.

08 is the exhaust gas outlet sending out the exhaust gas having done the expansion work in the turbine rotor 33. 31 is the compressor casing, 36 is the bearing housing to join the compressor casing 31 and the turbine casing 30. 37 is the bearing supporting the turbine rotor 33 mounted in the bearing housing 36.

2 is the nozzle vane, as placed equidistant in multiple along the circumferential direction of the turbine in the inner circumference of scroll 38, and the nozzle shaft 02 formed into thereof is supported for the rotary motion by the nozzle mount 4 fixed on the turbine casing 30, the wing angle of the nozzle vane is variable.

40 is an actuator rod, that is, the output end of an actuator 040 to drive the nozzle vane 2, and the reciprocating motion of actuator rod 40 is converted through the known link mechanism including a driving lever 41 into the rotating motion to be transferred to the link plate 3 of adjustable nozzle mechanism 100 described later.

In the supercharger with the variable capacity turbine in such a configuration, the exhaust gas from the internal combustion engine (not shown in figures here) flows into the scroll 38 and goes around along the spiral of scroll 38 further to nozzle vane 2. The exhaust gas runs through the wings of nozzle vane 2 to flow into the turbine rotor wheel 34 from the outer radius side thereof, and, after flowing in radial axis towards the shaft axis to perform the expansion work, flows in the shaft axis direction to the outside from the exhaust outlet 08.

100 is the adjustable nozzle mechanism rotating the nozzle vane 2 in order to change the wing angle thereof by use of link plate 3 driven in rotation around the rotating shaft 8 of turbine rotor 33, via connecting pin 3*a* and the lever plate 1, through the link mechanism which includes the actuator rod 40 and the driving lever 41 from the actuator 040.

This invention relates to the manufacturing method of the component part of an adjustable nozzle mechanism 100, in other words, a connecting pin which transmits the driving force to the engaging counter member by engaging with a recess or hole formed in the counter member, and a plate member connected to the connecting pin. More specifically, the invention relates to the manufacturing method for link plate 3 which configures a nozzle driving member, lever plate 1 which configures a connecting member, and a connecting pin which connect link plate 3 and lever plate 1, and it relates the structure of adjustable nozzle mechanism 100 manufactured by the above mentioned manufacturing method.

In FIGS. 1, 2, 4, 5, and FIG. 3(A) showing the first preferred embodiment of this invention, the link assembly 10 comprises a circular shaped link plate 3 and connecting pins 3*a* fixed thereon in a circumferential direction of the link plate with the method which will be mentioned later and it is formed as a single structure.

As shown in FIG. 1, at inner surface 3*c* of the circular-shaped link plate 3, the connecting pin 3*a* is formed which protrudes from a portion of the inner surface 3*c* as a column shape, and it is formed as a single structure with the link plate 3 (nozzle driving member). 3*b* is a pressed depression which is formed at the outer surface 3*d* when the connecting pin 3*a* is formed by a pressing which will be mentioned later.

1 is the lever plate which is provided between the nozzle mount 4 and link plate 3 in a shaft direction, and it connects the link plate 3 to the nozzle shaft 02 of nozzle vane 2. The lever plates are provided equal in number to the nozzle vane 2, where one edge side thereof is fixed on the nozzle shaft 02 of nozzle vane 2.

As shown in FIGS. 4 and 5, on the opposite edge of each lever plate 1, recess 1*c* is formed approximately in the radial direction and the recess 1*c* is engaged with the connecting pin 3*a*. The connecting pin 3*a* protrudes from the lever plate side of link plate 3 towards the lever plate 1, and the total number of connecting pins is the same as the number of lever plates 1.

In FIG. 3(A), 4 is the ring-shaped nozzle mount fixed on the turbine casing 30. 12 is the ring-shaped nozzle plate, 7 is the nozzle support, a plurality of which are placed along the circumferential direction between the nozzle mount 4 and the nozzle plate 12 to fix the nozzle mount 4 and the nozzle plate 12. The coupling section of nozzle support 7 on the nozzle plate 12 side is fixed to the nozzle plate 12 through the washer by punching the shaft end of nozzle support 7.

On the other hand, the nozzle vane 2 is placed at the inner radius section of nozzle support 7 between the nozzle mount 4 and the nozzle plate 12, and the nozzle shaft 02 fixed with the nozzle vane (or formed as a single structure with the nozzle vane) is supported on the nozzle mount 4 for rotating motion.

As shown in FIG. 5, which shows the coupling section of lever plate 1, nozzle vane 2, and nozzle shaft 02, the coupling hole 1*b* is provided on one edge side of lever plate 1 to couple with the nozzle shaft 02. The coupling hole 1*b* forms an oblong shape having two stopper surfaces 1*d* which are facing in parallel to each other. On the other hand, the coupling shaft 02*a* is provided to be fitted to the coupling hole 1*b* at the shaft edge of nozzle shaft 02 of nozzle vane 2. The coupling shaft 02*a* forms the same oblong shape as the coupling hole 1*b* to be fitted therein. Since the stopper surfaces on shaft 02*b* thereon in parallel to each other are attached to the stopper surfaces 1*d*, the lever plate 1, the nozzle vane 2, and nozzle shaft 02 are fitted to prevent the mutual rotation, and fitted firmly by punching the edge of coupling shaft 02*a* to prevent uncoupling of the coupling shaft.

In the following section, the method is explained referring to FIGS. 1, 2, 3(A) and 3(B), which is a method of manufacturing the link plate 3 for configuring the nozzle driving member, the lever plate 1 and the connecting pin 3*a* to connect the link plate 3 and lever plate 1 both of which configure the connecting member.

In the first preferred embodiment shown in FIGS. 1, 2, and FIG. 3(A), the connecting pin 3*a* is formed by a pressing as a single structure with the link plate 3.

As shown in FIG. 2, when forming the connecting pin 3*a* as a single structure with the link plate, the pressing comprises the steps of, contacting the male molder 51 which has the same outer diameter d1 as the outer diameter d of the connecting pin 3*a* to one side surface of the link plate 3 (the outer surface 3*d* shown in FIG. 1), contacting the female molder 52 which has the same inner diameter d2 as the outer diameter d of the connecting pin 3*a* to another side surface of the link plate 3 (the inner surface 3*c* shown in FIG. 1) at the corresponding position of the male molder 51, and pressing the male molder 51 by an oil press etc. with F press force against the link plate 3 for forming the press hole 3*b* (depression), all of which result in pushing the inner surface of link plate 3 into the molding cap 53 of the female molder 52 to form the column shaped connecting pin 3*a* which has an outer diameter d.

In the pressing process, a plurality of sets of the male molder 51 and the female molder 52 are arranged at the fixed positions for the connecting pins 3*a* along the circumferential direction of the link plate 3.

With the preferred embodiment mentioned above, the pressing work to form the column shaped connecting pin 3*a* has the steps of forming the press hole 3*b* (depression) by pressing the one side surface of the link plate 3 (the outer surface 3*d* shown in FIG. 1) to the other side surface of the link plate 3 (the inner surface 3*c* shown in FIG. 1) by the male molder 51 for depressing the outer surface, and forcing the inner side of the link plate 3 to protrude into the molding cap 53 of the female molder 52 to form the column shaped connecting pin. In the pressing work, a plurality of connecting pins can be formed at a same time only by a single press process by arranging the plurality of sets of the male molders 51 and the female molders 52 at the fixed positions for the connecting pins 3*a* along the circumferential direction of the link plate 3.

With this arrangement, it enables the formation of a plurality of connecting pins 3*a* to be provided along the circumferential direction of the link plate 3 by a single pressing process, and it can eliminate the additional process of manufacturing the connecting pin 03*a* separately from the link plate as the prior arts, and also eliminate the fixing process to attach the connecting pins 03*a* to the link plate 3. This results in forming the link assembly comprising the link plate 3 and the connecting pins 3*a* as a single structure, and drastically lowers the manufacturing count and cost of the link assembly compared to the prior arts.

In addition, since the link assembly 10 is manufactured as a single structure by uniting the link plate 3 and the connecting pins 3*a*, the number of the part count can be lowered compared to the prior arts in which the connecting pins 03*a* are manufactured separately from the link plate 3, and the link assembly 10 can become lighter in weight than the link assemblies of the prior arts.

FIG. 3(B) shows the second preferred embodiment of this invention. In this, the connecting pin 01*d* is formed by a pressing on the lever plate 1 as a single structure so that the formed connecting pin on the lever plate engages with the recess 03*c* formed in the lever plate 3.

In order to form the connecting pin 01*d* by a pressing as a single structure, as shown in the first preferred embodiment, it comprises the steps of, contacting the male molder 51 which has the same outer diameter d1 as the outer diameter d of the connecting pin 01*d* to one side surface of the lever plate 1, contacting the female molder 52 which has the same inner diameter d2 as the outer diameter d of the connecting pin 01*d* to the other side surface of the lever plate at the corresponding position of the male molder 51, and pressing the male molder 51 by an oil press etc. with F press force against the lever plate for forming the press hole (depression), all of which result in pushing another side surface of lever plate 1 into the molding cap 53 of the female molder 52 to form the column shaped connecting pin 01*d* which has an outer diameter d.

This pressing process is applied to each lever plate 1 out of a plurality of lever plates successively.

As an alternative, it can be manufactured by precision molding to mold the connecting pin 3*a* and the link plate 3, or the connecting pin 01*d* and the lever plate 1.

In the precision molding process as well as the pressing process, the machining process is not necessary, and the link assembly 10 mentioned above or the lever plate assembly united with the lever plate 1 and the connecting pin 01*d*, can be manufactured.

According to the invention mentioned above, since it uses a manufacturing method to form a column shaped connecting pin protruding from a surface of the plate member as a single structure with the plate member, in other words, it uses either the pressing method comprising a step of pressing one side surface of the plate member towards the opposite side surface to form the column shaped connecting pin or the precision molding method to form the connecting pin as a single structure with the plate member, and the component part for the variable capacity turbine including the nozzle driving member and the connecting member connecting the nozzle driving member and the nozzle vanes, are manufactured by these manufacturing methods, the work of forming the column shaped connecting pin on the plate member by the pressing or the precision molding, specially the work of forming a plurality of connecting pins along a circumferential direction of the nozzle driving member, can be performed by a single process of pressing or precision molding.

This can eliminate the additional work necessary to form the connecting pin separately from the nozzle driving member, as well as the work necessary to fix the connecting pins to the nozzle driving member. With this invention, the nozzle driving member and the connecting pins, or the connecting member and the connecting pins are formed as a single structure, and thus can dramatically cut the manufacturing count and manufacturing cost of the component part for the variable capacity turbine including the nozzle driving member and the connecting member as compared to the prior arts.

Further, by uniting the nozzle driving member and the connecting pins, or the connecting member and the pins, they can be a single structure, so the number of the component part will be decreased as compared to the prior arts in which the connecting pins are manufactured separately, and the total weight of the component parts used in the variable capacity turbine according to this invention will become lighter.

What is claimed is:

1. A manufacturing method for manufacturing a component part for a radial-flow variable capacity turbine, in which an actuating gas is forced to flow from a spiral scroll formed in a turbine casing to a turbine rotor in a radial direction through multiple nozzle vanes, which nozzle vanes have an angle that is adjustable by an adjustable nozzle mechanism, for rotating the turbine rotor, wherein, for manufacturing a connecting pin which transmits a driving force to an engaging counter member by engaging with a recess or a hole formed in the counter member out of the component part of the adjustable nozzle mechanism and a plate member connected to the connecting pin, said manufacturing method comprises:

forming the connecting pin as a single structure with said plate member by partially forcing a surface of said plate member to protrude in a column shape.

2. The manufacturing method of claim 1, wherein said forming comprises one side surface of the plate member being pressed towards an opposite side surface by a male molder to depress and form a depressed portion, and a protrusion formed on the opposite side surface of said depressed portion being accepted into a molding cap of a female molder in order to form said connecting pin having a column shape.

* * * * *